United States Patent [19]

Alig

[11] 4,178,531

[45] Dec. 11, 1979

[54] CRT WITH FIELD-EMISSION CATHODE

[75] Inventor: Roger C. Alig, Hightstown, N.J.

[73] Assignee: RCA Corporation, New York, N.Y.

[21] Appl. No.: 806,717

[22] Filed: Jun. 15, 1977

[51] Int. Cl.[2] ..... H01J 1/02; H01J 29/48

[52] U.S. Cl. ..... 313/409; 313/309; 313/444

[58] Field of Search ..... 313/409, 411, 309, 336

[56] References Cited

U.S. PATENT DOCUMENTS

| | | | |
|---|---|---|---|
| 3,665,241 | 5/1972 | Spindt et al. | 313/309 X |
| 3,755,704 | 8/1973 | Spindt et al. | 313/309 |
| 3,855,499 | 12/1974 | Yamada et al. | 313/336 X |
| 3,921,022 | 11/1975 | Levine | 313/336 X |

*Primary Examiner*—Robert Segal

*Attorney, Agent, or Firm*—E. M. Whitacre; G. H. Bruestte; L. Greenspan

[57] ABSTRACT

A cathode-ray tube comprises an evacuated envelope having therein a target and an electron-beam-producing means including a field-emission cathode therein. The beam-producing means comprises a plurality of spaced, pointed protuberances pointing in the same direction. Each protuberance has its own field-emission-producing means, a separate focusing-field-producing means for focusing the electrons emitted from the protuberance into a beam and means for modulating the individual beams in concert. The structure produces a plurality of modulated beams that are projected as a bundle in substantially parallel paths, which may be further operated upon as a single composite beam.

9 Claims, 5 Drawing Figures

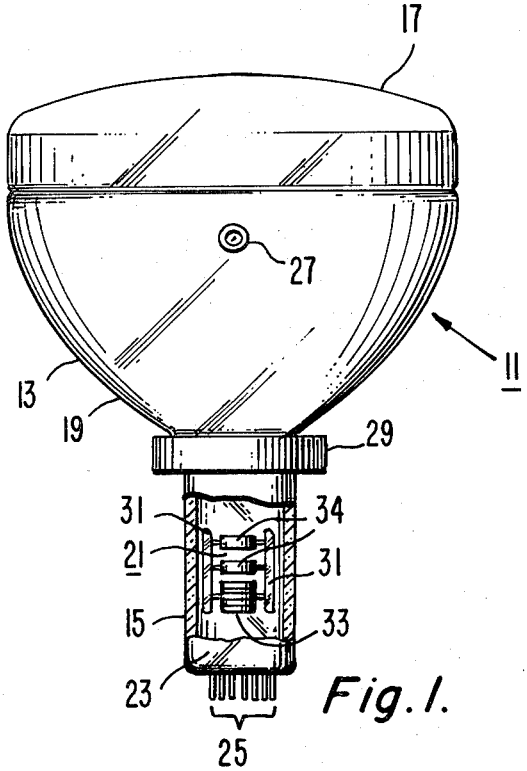
Fig. 1.
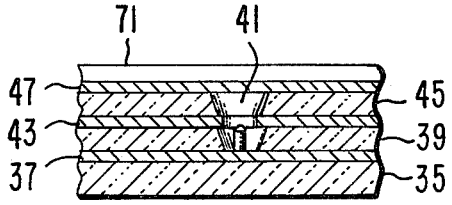
Fig. 4.
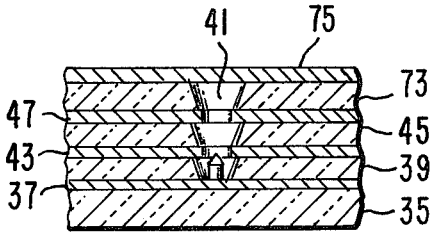
Fig. 5.
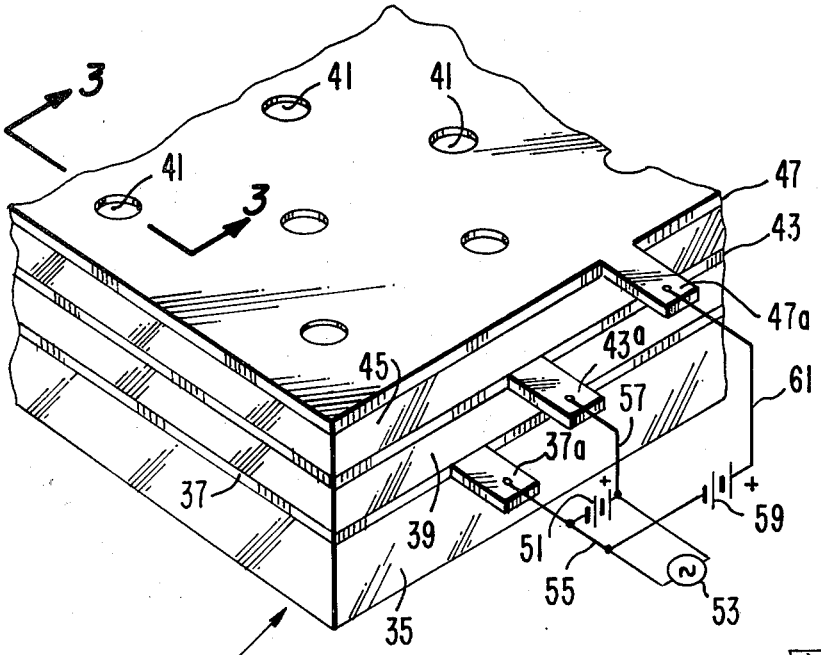
Fig. 2.
Fig. 3.
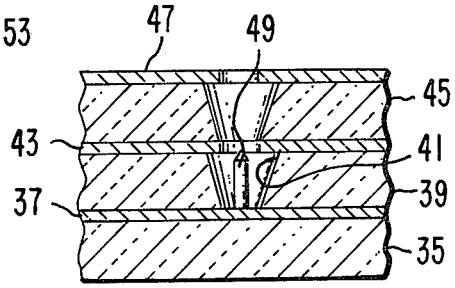

CRT WITH FIELD-EMISSION CATHODE

BACKGROUND OF THE INVENTION

This invention relates to a novel cathode-ray tube (CRT) having a field-emission cathode.

A CRT generally comprises an evacuated envelope having therein a target and means for producing one or more modulated electron beams in the envelope. The beam, or beams, is focused on and scanned over a target to perform a desired function. A beam-producing means, which is usually part of an electron gun, includes at least one cathode, which is the source of the electrons that are formed into a beam.

One type of cathode, referred to as a thermionic cathode, must be heated to a high operating temperature. A thermionic cathode requires a period of time to heat up after the tube is turned on and also dissipates power in order to maintain the high operating temperatures. The time delay for heating up and the power dissipation during operation are both undesirable features of a thermionic cathode. A beam-producing means comprising a thermionic cathode includes electrodes which may be separated from the cathode and from each other by fractions of a millimeter. These separations are fixed at room temperature, but must be maintained when the tube is operating. To achieve this, the structure must be designed to compensate for the heating effects resulting from the operation of the cathode at high temperatures.

Another type of cathode, referred to as a field-emission cathode, operates at about room temperature so that problems arising from high operating temperatures are completely avoided. Such a cathode employed in the beam-producing means of a CRT has been proposed. In one form, the cathode comprises a single point, or filament, from which electrons are emitted in response to an electric field produced by an associated electric-field-producing means. The current density that can be focused on the screen from such a source is inadequate for most CRT applications.

U.S. Pat. No. 3,866,077 to F. S. Baker et al proposes using an array of at least 1000 electron-emitting filaments in parallel in order to provide a composite beam with sufficient electron-beam current for most common uses of a CRT. While larger currents may be realized with this structure, the combined emissions of multiple filaments is too divergent to permit adequate focusing of the beam on the target of the CRT.

U.S. Pat. No. 3,921,022 to J. D. Levine proposes using a single protuberance having multiple points on the surface thereof which emit electrons in response to an electric field produced by an associated electric-field-producing means. Also included are means for producing a focusing field for the emitted electrons. Analysis indicates that the combined emission from this structure also is too divergent to permit adequate focusing of the composite beam on the target.

SUMMARY OF THE INVENTION

The novel CRT includes a field-emission cathode comprising an array of spaced, pointed protuberances or filaments, each pointing in substantially the same direction, each with its own electric-field-producing means for causing field emission of electrons therefrom. Each protuberance also has its own electric-field-producing means for separately focusing the emission from each point into a beam. The structure produces a plurality of beams that are projected as a bundle in substantially parallel paths. The bundle comprises a single composite beam which may be adequately focused on and scanned over the target of the CRT.

By providing an array of spaced protuberances, each pointed in substantially the same direction in combination with separate field-emission-producing means and separate field-focusing means for each protuberance, it is possible to produce a modulated composite beam which is adequately focused on the target of the tube and which has sufficient beam current for most CRT uses. The use of the disclosed field-emission structure avoids the disadvantages of high operating temperatures which are required for a structure employing a thermionic cathode.

BRIEF DESCRIPTION OF THE DRAWING

FIG. 1 is a partially-broken elevation of a novel CRT comprising an electron gun including a field-emission cathode.

FIG. 2 is a partially broken, perspective view of the composite structure portion of the electron gun employed in the CRT shown in FIG. 1.

FIG. 3 is a partially broken, sectional view along section lines 3—3 of the composite structure shown in FIG. 2.

FIG. 4 is a partially broken, sectional view of the composite structure shown in FIG. 3 during its fabrication.

FIG. 5 is a partially broken sectional view of an alternative composite structure for the electron gun employed in the CRT shown in FIG. 1.

DETAILED DESCRIPTION OF THE PREFERRED EMBODIMENT

In FIG. 1, a cathode-ray tube 11 comprises an envelope 13 including a neck 15, a faceplate panel 17 and an interconnecting funnel 19. An electron gun 21 in the neck 15 is adapted to project an electron beam toward the panel 17. The neck 15 is closed at one end by a stem 23 through which a plurality of leads 25 are sealed. Suitable operating voltages are supplied to the electron gun 21 through the leads 25. A conductive coating (not shown) is provided on the internal surface of the funnel 19. The conductive coating is connected to an anode button 27 to which a suitable high voltage may be supplied during the operation of the tube 11. A luminescent screen or target (not shown) on the internal surface of the panel 17 comprises one or more layers of particles which are adpated to luminesce in one or more colors when excited by the electron beam from the gun 21. A magnetic-deflection yoke 29 is positioned adjacent the juncture between the neck 15 and the funnel 19 for deflecting the electron beam to scan a raster over the screen. Except for the electron gun, the tube may be constructed and operated as in the prior art.

The electron gun 21 includes several electrodes or grids supported on glass beads 31, including a composite structure 33, shown in more detail in FIGS. 2 and 3, for producing, modulating and collimating a composite electron beam. The composite structure 33 corresponds functionally to the cathode, control grid, and screen grid electrodes of a conventional thermionic-cathode electron gun. The electron gun 21 includes additional electrodes 34, corresponding to the focusing and ultor electrodes of a conventional electron gun for focusing the composite electron beam.

In the embodiment shown in FIGS. 2 and 3, the composite structure 33 comprises a substrate 35 which may be of a ceramic, sapphire or metal material. The substrate 35 is provided for the purpose of supporting the overlying structure and, if the overlying structure is self-supporting, the substrate 35 may be omitted. A conducting base 37 rests on one surface of the substrate 35. The base 37 may be a metal film, such as of molybdenum or tungsten metal. A first dielectric film 39, such as of aluminum oxide or silicon oxide, is deposited over the base 37 and is provided with an array of apertures 41.

A first electrode 43 (corresponding to the control grid of a conventional electrode gun) rests on the first dielectric film 39. The first electrode 43 is of metal, such as molybdenum or tungsten, and has an array of apertures therein substantially coaxial with the apertures 41 in the first dielectric film 39. A second dielectric film 45 rests on the first electrode 43 and is substantially identical with the first dielectric film 39. A second electrode 47 rests on the second dielectric film 45 and is substantially identical with the first electrode 43. For simplicity, the aperture 41 is considered to extend from the first film 39 through all of the overlying layers. As shown in FIG. 2, the base 37 has an integral connection tab 37*a*; the first electrode 43 has an integral connection tab 43*a*; and the second electrode 47 has an integral connection tab 47*a*. The tabs 37*a*, 43*a* and 47*a* extend from the composite structure 33.

A single pointed protuberance 49 is centered in each of the apertures 41. The protuberances 49, which are in an array, are preferably all of the same size and shape and formed of the same material as the second electrode 47. Each protuberance 49 rests on and is electrically connected to the base 37, with the extended point thereof pointing in a direction that is substantially normal to the plane of the base 37. Generally, $10^2$ to $10^5$ protuberances per square millimeter may be used in practical structures. The protuberances may be in a regular array or a random array.

For producing a desired field emission from the point of each of the protuberances 49, a first voltage from a first voltage source 51 and a signal voltage from a signal source 53 are applied across the tabs 37*a* and 43*a* through leads 55 and 57 respectively. Alternatively, the first voltage source 51 may itself be variable, in which case the separate signal source may be omitted. Upon application of a first voltage between the base tab 37*a* and the first electrode tab 43*a*, an electric field is established between the point of each protuberance 49 and the nearest portion of the first electrode 43, thus causing electrons to be emitted from the point of the protuberance through the aperture 41 in the first electrode 43. The signal voltage from the source 53 modulates the emission current of all of the beams in concert with voltages less than 500 volts.

For producing a desired focusing of the emitted electrons, a second voltage from a second voltage source 59 is applied across the tabs 37*a* and 47*a* through leads 55 and 61. Upon the application of the second voltage, a second electric field is established between the first and second electrodes 43 and 47 in each aperture 41. The second electric field focuses the emitted electrons in each aperture 41 into a substantially collimated beam. Substantially parallel beams emerge from the apertures 41 and together comprise a composite, modulated beam which then passes through the electrodes 34 of the gun 21 where it is focused upon the target or screen of the tube 11 and then through the deflection means 29 which causes the focused composite, modulated beam to scan over the target.

In one particular embodiment, the base 37 is a film of molybdenum metal about 0.25 to 1.00 micron thick deposited on a substrate 35 of sapphire. The dielectric films 39 and 45 are of aluminum oxide about 0.5 to 2.0 microns thick. The electrodes 43 and 47 are films of molybdenum metal about 0.25 to 1.00 micron thick. The apertures 41 have a minimum diameter of about 2.0 microns on about 6.0 micron centers, or about $10^4$ emission sites per square millimeter. The protuberances are about 1.0 micron in diameter at the base and taper to sharp points having radii of less than 100 Å.

Much of the construction of the metal/insulator/metal sandwich structure shown in FIGS. 2 and 3 can be done utilizing prior methods for making an electron-emitting structure; for example, the methods described by C. A. Spindt et al in U.S. Pat. No. 3,755,704. Beginning with the structure illustrated in FIG. 9 of that patent, it is necessary only to extend the aperture 41 through the second electrode 47 above each protuberance 49. This may be done by applying a photo- or thermal-resist layer 71 onto the upper side of the second electrode 47 as shown in FIG. 4 herein, and then applying positive voltages to this electrode 47 and the first electrode 43 relative to the base plate 37. This may be done using the first and second voltage sources 51 and 59 connected through the tabs 37*a*, 43*a* and 47*a*. Field-emitted electrons from the protuberance strike the lower side of this plate 47 and generate radiation, either ultraviolet or thermal, which exposes the resist above the portions of the plate 47 which are to be apertures. The exposed resist is dissolved away, and the exposed surface is etched to create the apertures 41. The remaining resist is then washed away. Additional layers may be added to this sandwich structure by vapor deposition of a layer 73 of an insulating material at a grazing angle from all sides of the aperture 41 to partially or completely close up the structure as shown in FIG 5. A metal layer 75 is evaporated atop this insulating layer 73, and the process described in the preceding paragraph is repeated. U.S. Pat. No. 3,812,559 discloses still another method which may be adapted to make the composite electron-emitting structure described herein.

There may be other techniques for producing these apertures. For example, using the currents and voltages given by C. A. Spindt et al, JOURNAL OF APPLIED PHYSICS 47, 5248 (1976), it is quite likely that the aperture can be burned out by the electron beam coming up from below the plate, making the use of a resist layer unnecessary. Other procedures that could be used include milling of the apertures by an ion beam incident on the upper surface of the last plate shown in FIG. 9 of U.S. Pat. No. 3,755,704. A single element may be used as a fiduciary point, and the map used in generating the original apertures (see lines 50 to 65 of column 3 of U.S. Pat. No. 3,755,704) can be used to guide the ion beam. Alternatively, a strong electric field will attract metal, and such a field may be used to remove the unbonded metal above the protuberances. Finally, a structure similar to that shown in FIGS. 2 and 3 herein may be reached utilizing the technology described by J. K. Cochran et al in the AMER. CER. SOC. BULL. 54, 426 (1975).

The composite structure 33 may be mounted on a standard G1 grid electrode support. Several composite structures 33 may be mounted in parallel. The structures are attached to this support using known (brazing or welding) techniques in a convenient geometry, such as the inline geometry. They may be mounted in the holes which normally support the G1 aperture plates, or these holes may be absent and the composite structures may be mounted directly atop the support. If the substrate 35 is a conductor, electrical contact to the base 37 of the composite structure can be made directly to this support. Electric wires connected to tabs on each of the metal layers are led out through pins in the stem of the tube.

To operate the novel CRT, the voltages usually applied to a CRT with a thermionic cathode are applied in the usual way to all the tube components, except those applied to the heater-cathode assembly and the first two grid electrodes. With the wires described above, a positive voltage is applied between each apertured electrode with respect to the base 37. The signal voltage normally applied between the cathode and first grid in a CRT is now applied between the first electrode and the base 37. For a signal voltage below 150 V, as is commonly found in a CRT, the first dc voltage between the base 37 and first electrode 43 should not exceed 500 V. The other dc voltages, as well as the thicknesses and separations of the second electrode 43 and subsequent electrodes 34, are chosen to confine most (about 90% or more) of the electron beam emerging from the composite structure 33 into a cone of apex angle below 2°. The voltages on the remaining portions of the electron gun are chosen to focus all of these beams into the same small region of the phosphor screen.

The field-emission structure of the novel CRT differs from the single field-emitter electrode commonly used in a scanning electron microscope (SEM) in at least the following respects: (a) The radius of the emitting tip of an element of the array is less than 500 Å whereas the tip radius in an SEM is about 5000 Å. (b) The voltage between the tip and the nearest electrode is about 100 V in this array whereas it is about 5000 V in an SEM. This large voltage would not be acceptable for a display tube because it could not be easily modulated with conventional circuits to produce a display with good contrast on the screen. (c) Most (more than 99%) of the current from the tip in an SEM is intercepted by a limiting aperture in the electron gun whereas most of the current from the tip is transmitted through the gun in the novel CRT.

The foregoing disclosure invites a more detailed comparison of prior electron-emitting structures with the electron-emitting structure employed in the novel CRT. Among the existing devices using field-emission cathodes, the scanning electron microscope, or SEM, is most nearly like a display CRT. The electron gun of an SEM may consist of the field-emitting tip and a series of apertured plates, called anodes, which lie in front of the cathode. These anodes are held at potentials of several kilovolts relative to the emitting tip and they form all or part of a lens which focuses the electron beam on the screen.

This SEM electron gun differs from an electron gun having a thermionic cathode usually used in a display CRT in several ways. First, the beam current projected by the SEM gun is typically about a microampere instead of more than a milliampere used in a CRT. Second, there is no provision in the SEM electron gun for modulation of the beam, a characteristic needed to create a display CRT. Third, because modulation in the CRT electron gun must be done at MHz rates, it must be done with less than 500 volts; yet the voltages used in the SEM electron gun are normally several kilovolts. These differences, i.e., modulation of a high current beam, with relatively low voltage require the array of field emitters as described herein.

The current in the electron beam from thermionic cathodes is commonly modulated at the first anode of the electron gun, frequently called the control grid or the Wehnelt electrode. Thus, for maximum compatability with existing displays, it seems reasonable to modulate a field-emission cathode at the control grid; also it is hard to see where else to modulate it. The beam current modulation must be sufficient to produce a 50:1 contrast ratio at the screen, and this contrast ratio must be generated with voltage changes of about 200 V.

The current density j from a tip of a field-emission cathode is related to the field F at the tip by the Fowler-Nordheim equation, which is approximately $$j=(1.5F^2/\phi)\exp(-7\times10^7\phi^{3/2}/F)\ \mu A/cm^2, \quad (1)$$

where $\phi$ is the work function of the emitting tip in eV and F is the field at the tip in V/cm. The field at the tip is approximately $F=V_1/5R$ where $V_1$ is the voltage on the first anode and R is the tip radius. The current i from a tip is $i=2\pi R^2 j$, assuming the upper hemisphere of the tip is emitting, and from an array of N tips is $$i=2\pi NR^2 j. \quad (2)$$

A maximum current $i_m=1$mA, characteristic of television displays, will be assumed to be drawn from the array when the maximum current density $j_m$ is being drawn from the tips. Since the maximum current density $j_m$ that can be drawn continuously from known tip materials is about $10^6$ A/cm$^2$, Eq. (2) can be used to define the tip radius, i.e., $$i_m=2\pi NR^2 j_m. \quad (3)$$

Using Eqs. (1)–(3), one obtains $$i=(3\pi NV_1^2/25\phi)\exp(-4000\phi^{3/2}/V_1\sqrt{N})\ \mu A. \quad (4)$$

The value of $V_1\sqrt{N}$ must decrease by at least 30% to lower the current i by a factor of 50; hence the maximum voltage on the first anode cannot exceed three times the modulation voltage, i.e., it cannot exceed 500 V for commonly used modulation voltages. For i=1 mA, $V_1\sqrt{N}$ exceeds 500 V for the work functions of most materials. Thus N must exceed unity, i.e., an array must be employed to obtain the required 1mA of current from a field-emission cathode.

Both field-emission cathodes and thermionic cathodes have been used in SEM's for many years. In this application, it is desirable to focus a given beam current into the smallest possible spot. There seems to be a consensus that field-emission cathodes can put more current than thermionic cathodes in the same size spot for currents below 1 microampere; the spot diameter at this current is about 1000 Å. For larger currents the spot diameter from a field-emission cathode increases as the 3/2 power of the current while that of a thermionic cathode increases as the $\frac{3}{8}$ power of the current. For both cathodes this minimum spot size at high currents is fixed by spherical aberrations of the anode apertures.

The desire to obtain the smallest spot size for a given beam current is also present in the design of CRT electron guns. However, for spot diameters below 1 mm, the spot need not be smaller than a scan line width of the display. Using the 3/2 power law mentioned above, the field-emission cathode current may rise to nearly 1 milliampere before this lower bound on the spot size is reached. However, since CRT displays frequently require more than a milliampere of current, either an array of field emission cathodes must be used or the focusing lens must have less spherical aberration than the lenses commonly used in SEM's. It is also apparent from this bound on the spot size that each emitter of an array of field-emitters must be provided with its own lens, i.e., the cathode array must include an array of elemental lenses.

The size of the focused spot is very important in a CRT because, if it is too large, it limits the resolution of the image displayed on the screen. In the usual CRT electron gun with a thermionic cathode, the principal contributions to the spot size are due to three sources. These are space-charge repulsion of the electrons comprising the beam, magnification of the cathode image on the screen, and spherical aberrations in the lens used to focus the beam. Since the space-charge repulsion occurs in the region between the electron gun and the screen, it is apparent the nature of the cathode has little effect on this source. However, the latter two sources will be quite different for field emission and thermionic cathodes.

In an SEM, the image of a single field-emitting tip is focused on the screen. The only interesting geometric feature of the tip image on the screen is its size. However, when two emitting tips are present, there will be, in general, two images on the screen. In addition to their size, their separation is also of interest because both these distances contribute to the total spot size. Since images of existing field-emitting cathode arrays consist of a distribution of distinct spots, it appears that the separation of the images of the tips determines the overall image size.

The size of the image of the cathode on the screen is determined, in part, by the magnification of the lens system; typically it is of order unity in an SEM. The size of the image of a single field-emitting tip, however, can still be quite small, for the apparent source diameter can be as small as 50 Å even though the tip itself is 5000 Å in diameter. The apparent separation of two tips, however, is equal to the actual separation of the tips and so the distance between their images on the screen will be this separation multiplied by the lens magnification. Thus, the magnification of the focusing lens will be critical in the definition of the spot size from an array of field-emitting tips.

For a thermionic cathode, the contribution to the spot radius due to crossover, or cathode, magnification is frequently expressed as $$m_t = r_f/r_i = (kT/e\Phi)^{\frac{1}{2}} \sin^{-1} \phi_f \quad (5)$$

where $r_i$ and $r_f$ are the source and image radii, the convergence angle of the beam as it leaves the lens is $\phi_f$, the cathode temperature is T, and the ultor voltage is $\phi$. This relation is based on Abbe's sine law which relates the products of the initial and final spot radii, convergence angles, and electron velocities. The above expression is $$r_f \sin \theta_f \sqrt{e\Phi} = r_i 1 \cdot \sqrt{kT}$$

since the electrons are emitted into a hemisphere above the cathode.

For a field-emission cathode, the electrons are emitted into a smaller cone angle above the cathode than for a thermionic cathode, but the emission energy, i.e., the energy with which the electrons enter the main focusing lens, is much larger than kT. The cone half-angle $\theta_i$ of electron emission is ordinarily of the order of 30°, but it can be kept below 15°. It can be lowered further by the aperture of the control grid with the loss of current. The emission energy is of the order of the voltage $V_1$ on the control grid, or, as was shown in the preceding section, about 500 V for a cathode array. Hence, for a field-emission cathode the cathode magnification is $$m_{fe} = r_f/r_i = (V_1/\Phi)^{\frac{1}{2}} (\sin \theta_i / \sin \theta_f) \quad (6)$$

by Abbe's sine law. For $\theta_i = 15°$ and kT=0.1 eV, Eqs. (5) and (6) yield $m_{fe} = 20\ m_t$, i.e., the cathode magnification is at least a factor 20 larger for a field-emission cathode than for a thermionic cathode.

This large difference in the magnification of an electron beam from these two cathodes is largely due to the different physical mechanisms by which the emission takes place. Field emission is field-limited, whereas thermionic emission is space-charge-limited. In field-limited emission, the electron trajectories near the cathode are controlled by the detailed shape of the emitting surface and so the electrons enter the lens with a velocity proportional to the root of the control grid voltage. In space-charge-limited emission, however, the detailed shape of the cathode is masked by the space-charge field, and the electrons enter the lens with thermal velocities. Indeed, when the temperature of a thermionic cathode is lowered so that the emission passes from the space-charge-limited regime to the field-limited regime, the initial energies of the electrons entering the lens change from 0.1 eV to several eV due to emission from cathode irregulartiies.

Frequently, the contribution to the image spot radius due to spherical aberrations is written $\delta = C_S \theta_i^3$ where $C_S$ is the coefficient of spherical aberrations. From Eq. (6) the contribution to the spot size due to spherical aberrations is then $r_a = m_{fe}\delta$; then $$C_S = r_a / m_{fe} \theta_i^3. \quad (7)$$

Since $r_a$ must not exceed 1 mm in a television display and $m_{fe}\theta_i^3$ is of the order of 0.1 when $\theta_i$ is several degrees, $C_S$ must be less than 1 cm for the lens of a field-emission cathode in a television display. This coefficient of spherical aberration is similar to the coefficient for the lens of an SEM gun.

For a thermionic cathode an analysis similar to that preceding Eq. (7) yields $$C_S' = r_a / m_t \alpha^3 \quad (8)$$

where $\alpha$ is the cone half-angle at which an electron beam leaves the cross-over. Since $m_t = 20 m_{fe}$ and $\alpha$ is typically a couple of degrees, $C_S'$ can be much larger than $C_S$ before the focused spot is deformed.

Thus the spherical aberration of the electron lens in a television display must be reduced substantially when the thermionic cathode is replaced by a field-emission cathode. Equations (6) and (7) emphasize the necessity for field emission into a narrow cone in order to focus the beam into a spot of tolerable size.

For the reasons given above a field-emission cathode for a CRT must consist of an array of emitters, the voltage on the control grid must not exceed 500 V, and each emitter of the array must have an associated elemental lens. This last conclusion can also be reached from a different line of reasoning which utilizes the results of the preceding section.

When a single anode is used with a field-emitter array, the average current density emitted from the array is near its maximum for emitter tips separated by about 100 tip radii when the anode voltage is about 1 kV. This optimum tip separation shows that a field of $10^7$ V/cm is required for reasonable emission of current and that a field concentration of $10^4$ times this anode potential is needed to achieve this field. Since the maximum emission current density of a field emitter does not exceed $10^6$ A/cm$^2$ and only $10^{-4}$ of the cathode area is emitting, the maximum average emission current density at this optimum separation is 100 A/cm$^2$. The magnification of this cathode was shown in the preceding section to be 20 times that of a thermionic cathode, so the maximum average current density of a field-emitter array, corrected for comparison with a thermionic cathode, is less than 1 A/cm$^2$; but this is no greater than the emission current density of a conventional thermionic cathode. Thus, by Langmuir's law, the current density on the screen cannot exceed that presently obtained with a thermionic cathode. Therefore, there seems little hope of matching the performance of a thermionic cathode in a television display tube using a field-emission cathode array with a single focusing field.

Since a single focusing field cannot be used with a field-emission cathode array, a separate focusing field must be used with each emitting point. The gun shown in FIGS. 1 to 3 is a tubular structure with a typical bipotential lens. The base 37 is held at ground potential. The first electrode 43 is at potential $V_1$ and the second electrode 47 at potential $V_I$.

Field-emitted electrons pass through two electron lens in going from the tips of the array of protuberances 49 to the screen of the CRT. The first lens is produced when voltages are applied to the emitter-lens array of the composite structure 33. If the energies with which electrons enter and leave this lens be denoted $eV_1$ and $eV_I$, the angular bounds on the electron trajectories be $\theta_i$ and $\theta_I$, the radius of the virtual electron source be $r_e$, and the radius of its image be $r_b$; then Abbe's sine law yields $$r_e\sqrt{V_1}\sin\theta_i = r_b\sqrt{V_I}\sin\theta_I. \quad (9)$$

The second lens is the bipotential lens formed when suitable voltages are applied to the additional electrodes 34. If the energies with which electrons enter and leave this lens be denoted $eV_I$ and $e\Phi$, the angular bounds on the electron trajectories be $\theta_I$ and $\theta_f$, the radius of the emitter-lens array be $r_i$, where $r_i >> r_b$, and the radius of the focused spot on the screen be $r_f$; then Abbe's sine law yields $$r_i\sqrt{V_I}\sin\theta_I = r_f\sqrt{\Phi}\sin\theta_f. \quad (10)$$

From Eqs. (9) and (10) the magnification is $$m_{fe}' = (r_e/r_b)(V_1/\Phi)^{\frac{1}{2}}(\sin\theta_i/\sin\theta_f) = (r_e/r_b)m_{fe} \quad (11)$$

where the last expression was obtained from Eq. (6). As indicated in Eq. (11) the magnification of an emitter-lens array $m_{fe}'$ differs from the magnification of an emitter array by the factor $r_e/r_b$. This result is not surprising for if all the lenses were aberration free, etc., and the emitting tip could be placed exactly on the focal point of its lens, the beam entering the second lens would be perfectly collimated, and with the screen in its focal plane, the second lens would focus this parallel beam to a point.

Since $m_{fe}$ is approximately 20 $m_t$ the magnification $m_{fe}'$ of an emitter-lens array would not exceed that of a thermionic cathode if $r_b > 20\ r_e$. If the difference in $V_1$ and $V_I$ is ignored, this inequality becomes $\sin\theta_i > 20 \sin\theta_I$ by Eq. (9); for $\theta_i = 15°$ this inequality is $\theta_I < 1.0°$. This limit on the angular divergence of the beam exiting the emitter-lens array of the composite structure 33 fixes bounds on the quality, e.g. spherical aberration, of the elemental lenses of the array and on the tolerance in the placement of the emitting tips relative to the anode apertures. That is, $r_e$ is, in fact, the radius of a circle at the center of each elemental lens within which the emission must occur.

I claim:

1. A cathode-ray tube comprising an evacuated envelope having therein a target and an electron-beam-producing structure comprising a plurality of spaced, pointed protuberances pointing in substantially the same direction, each protuberance having associated therewith its own separate first electric-field-producing means for causing electric-field emission of electrons therefrom, each protuberance also having associated therewith its own separate second electric-field-producing means for focusing the electrons emitted from said protuberance into a beam, said structure being adapted to project said beams along closely spaced substantially parallel paths to constitute a composite beam, and further means along said paths for focusing said composite beam on said target.

2. The tube defined in claim 1 wherein said protuberances have points with radii of less than 500 Å.

3. The tube defined in claim 2 wherein said protuberances are arranged in a regular array having about $10^2$ to $10^5$ protuberances per square millimeter.

4. The tube defined in claim 2 having a magnetic deflection yoke operatively associated with said tube for scanning a raster on said target with said composite beam.

5. The tube defined in claim 2 including means for modulating all of said beams in concert with voltages of less than 500 volts.

6. A cathode-ray tube comprising an evacuated envelope having therein a target and an electron-beam-producing structure comprising (a) a conducting base having a major surface, (b) a plurality of spaced, pointed protuberances on said surface, said protuberances pointing in a direction substantially normal to said surface, (c) at least two conducting electrodes insulatingly spaced from and substantially parallel to each other and to said surface, each of said electrodes having a plurality of apertures therethrough, each aperture in one electrode being substantially coaxial with one of the apertures in the other electrode and further being substantially coaxial with one of said protuberances, one of said electrodes being insulatingly spaced from and substantially parallel to said conducting base, (d) means for applying a first voltage between said conducting base and said one of said electrodes for causing electric-field emission of electrons from said protuberances, (e) and means for applying a second voltage between said two conducting electrodes for focusing the emission from said protuberances into a plurality of closely-spaced substantially parallel beams.

7. The tube defined in claim 6 wherein said plurality of protuberances are in a regular array having about $10^4$ protuberances per square millimeter.

8. The tube defined in claim 6 wherein said first voltage is effective to cause field emission of a beam of electrons from said protuberances and said second voltage is effective to produce a focusing electric field between each aperture in one electrode and the coaxial aperture in the other electrode for focusing the beam of electrons emitted from the protuberance associated therewith into a collimated beam.

9. The tube defined in claim 8 including means for applying a signal between said conducting base and said one electrode insulatingly spaced therefrom, said signal being effective to modulate the beams of electrons emitted by said protuberances.

* * * * *